United States Patent [19]

Kelly

[11] 4,449,336

[45] May 22, 1984

[54] FIRE BARRIER RESERVOIR

[76] Inventor: Thomas L. Kelly, 21 Sands St., Waterbury, Conn. 06710

[21] Appl. No.: 399,213

[22] Filed: Jul. 19, 1982

Related U.S. Application Data

[63] Continuation-in-part of Ser. No. 160,948, Jun. 19, 1980, abandoned.

[51] Int. Cl.[3] ..... E04B 1/00; E04C 2/00; E04D 5/00; E04B 1/76

[52] U.S. Cl. ..... 52/105; 52/232; 52/309.4; 52/404; 52/408; 52/409; 52/478

[58] Field of Search ..... 52/105, 232, 309.1, 52/309.4, 309.8, 309.12, 408, 404, 409, 478; 428/138, 920

[56] References Cited

U.S. PATENT DOCUMENTS

| | | | |
|---|---|---|---|
| 2,861,525 | 11/1958 | Curtis et al. | 52/408 X |
| 3,028,277 | 4/1962 | Dunn | 428/138 |
| 3,266,206 | 8/1966 | Cosby et al. | 52/408 X |
| 3,282,008 | 11/1966 | Sheahan | 52/516 |
| 3,318,056 | 5/1967 | Thompson | 52/105 |
| 3,763,609 | 10/1973 | Probst | 52/105 |
| 3,763,614 | 10/1973 | Hyde et al. | 52/408 X |

FOREIGN PATENT DOCUMENTS

| | | | |
|---|---|---|---|
| 543619 | 12/1955 | Belgium | 52/408 |
| 1262639 | 4/1961 | France | 52/404 |
| 135639 | 5/1979 | German Democratic Rep. | 52/309.6 |
| 614189 | 7/1978 | U.S.S.R. | 52/408 |

*Primary Examiner*—Alfred C. Perham
*Attorney, Agent, or Firm*—Hayes & Reinsmith

[57] ABSTRACT

A roofing structure including a plurality of abutting fireproof sections and a reservoir board having apertures therein, the reservoir board mounted on and secured to the sections of the fireproof member. Insulation mounted on said reservoir board and covering said apertures therein. In the event of a fire in the building covered by the roof, the insulation will become molten and under normal circumstances would flow on to the fireproof member and leak therefrom at the seams between abutting sections of the fireproof member and flow therethrough downwardly of the roof. This molten insulation would serve to intensify the fire within the building. Indicia is provided on the reservoir board to aid in the proper installation thereof so that the apertures therein will not be positioned above the seams in the fireproof member. In a modification of the invention the reservoir board is eliminated and the fireproof member is provided with a plurality of cups formed therein to receive and to hold the molten insulation. A further modification involves a roofing structure in which the fire reservoir board upon which the insulation is mounted is composed of wood fiberboard and is provided with the apertures therein for holding the molten insulation and keeping it from flowing on to the lower roofing structure elements. In this form of the invention the fireproof member is eliminated.

20 Claims, 11 Drawing Figures

FIRE BARRIER RESERVOIR

This application is a continuation-in-part of U.S. patent application Ser. No. 06/160,948 filed June 19, 1980, now abandoned.

BRIEF SUMMARY OF THE INVENTION

A significant purpose of this invention resides in the provision of a roofing element for a building which provides means therein functioning as a fire barrier in the event of a fire within the building. The roofing structure of this invention includes a plurality of elements one of which is insulation which may be of the plastic air entrapment type. When a fire occurs in the building covered by the roof of this invention the heat from such fire causes the insulation to become molten and flowable, and the insulation and a reservoir board are mounted on a fireproof member which includes a plurality of abutting sections, and this molten insulation will leak between the seams at the abutting edges of the sections of the fireproof member. It is one of the significant objects of this invention to provide means incorporated in the roof structure for preventing such molten insulation from flowing downwardly between the seams of the abutting edges of the sections of the fireproof member of the roof. This highly advantageous characteristic of the roof is accomplished by means of what I shall term a "reservoir board" which is provided with a plurality of spaced apart apertures therein. The reservoir board being mounted on the sections of the fireproof member and the insulation being mounted on the reservoir board. The plurality of apertures in the reservoir board in combination with its mounting on and adherence to the sections of the fireproof member provide in effect cups into which the molten insulation flows and which function to retain such molten insulation and to keep it from reaching the seams between the sections of the fireproof member for leakage therethrough. It is also within my contemplation to eliminate the reservoir board and instead form the sections of the fireproof member with cutouts therein which provide cups for receiving the molten insulation. In this form of the invention the insulation would be supported upon the sections of the fireproof member and such cups therein would prevent the flow of molten insulation from reaching the seams between sections of the fireproof member so that there would be no leakage of the molten insulation through such seams.

Since it is not desirable to have the apertures in the reservoir board in a vertical plane which coincides with the vertical plane of the seams between the sections of the fireproof member. To accomplish this I have devised a visual indication to the roof installer so that the apertures in the reservoir board will not be aligned with the seams between sections of the fireproof member when the roof is assembled.

In one form of this invention the fireproof member is eliminated and in its stead a wood fiberboard barrier is used and this barrier is provided with a plurality of spaced apart apertures therein forming cups for receiving the molten insulation in the event of a fire and keeping such molten insulation from flowing on and distorting the remaining elements of the roof structure. It must be appreciated that the wood fiberboard which functions as a fire barrier in this form of the invention will not burn, instead it will become charcoal and it has been determined that it has a better burn rating than the elements of the steel deck which are disposed beneath the wood fiberboard barrier and are protected thereby from the molten insulation. It should also be understood that when the fireproof member is eliminated and this wood fiberboard barrier is substituted therefor the problem of seams between sections of the fireproof member is no longer encountered.

Additional objects and advantages of the present invention will become more readily apparent to those skilled in the art when the following general statements and descriptions are read in the light of the appended drawings.

DETAILED DESCRIPTION

Figure 1:
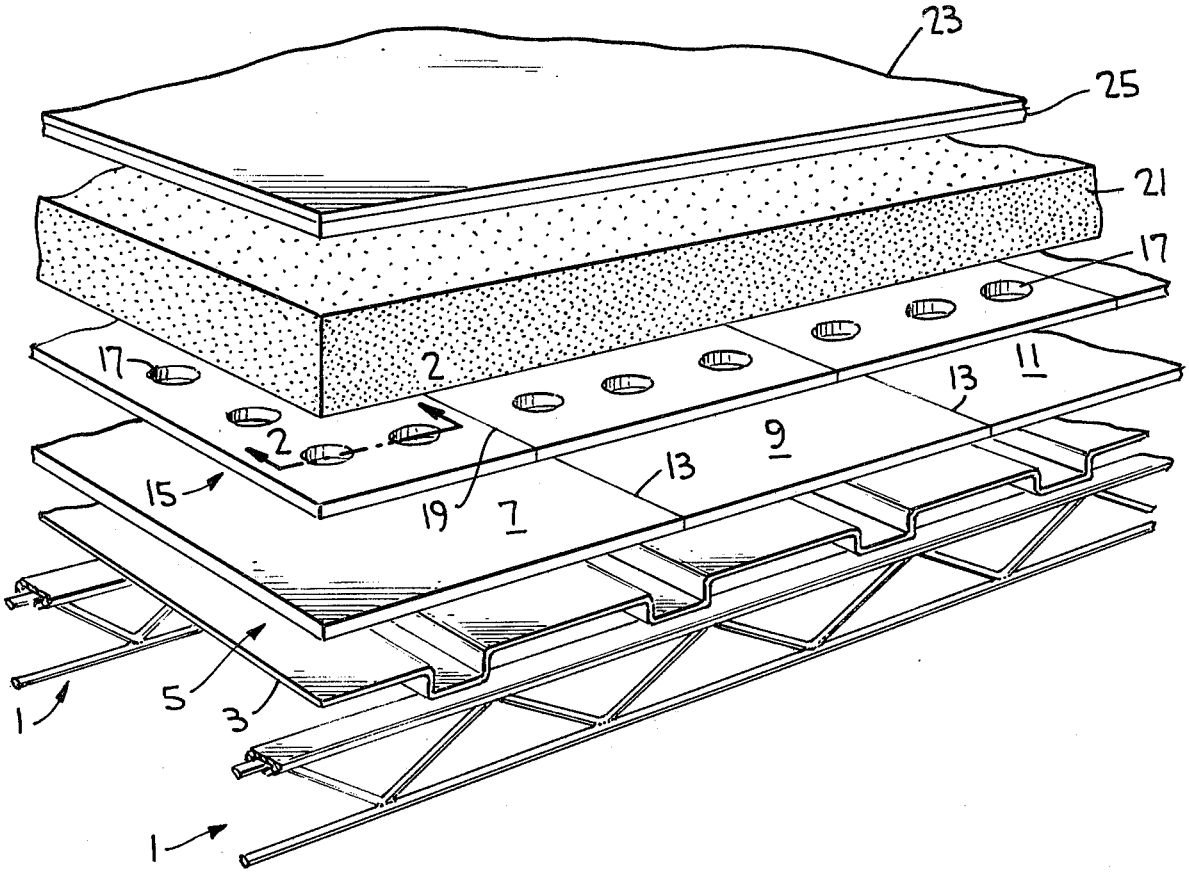
FIG. 1 is a perspective view in section of a part of a roof embodying this invention, the elements of the roof being illustrated in exploded positions.

In the accompanying drawings and particularly FIG. 1 thereof a roofing structure is illustrated which includes spaced apart steel joints illustrated generally by the numeral 1. Upon such roof joists a metal decking 3 is supported and on this metal decking is mounted a fireproof member 5 composed of a plurality of sections designated by the numerals 7, 9 and 11, the edges of the sections abutting to provide seams 13 therebetween. The sections 5 of the fireproof member are preferably formed of plasterboard and such plasterboard sections may be on the order of $\frac{5}{8}''$ in thickness. The plasterboard sections 5 may be secured in any suitable manner to the metal deck 3. The reservoir board has been designated in its entirety by the numeral 15 and may be formed of gypsum, fiberboard, Perlite, or any other suitable material and is preferably on the order of $\frac{1}{2}''$ in thickness. The reservoir board 15 is provided with a plurality of apertures 17 therein and is also provided with visible indicia lines 19 on the upper surface thereof, the function of these indicia lines will be made clear hereinafter.

At this time, however, it should be noted that no apertures 17 are formed on the visible indicia lines 19 and while I have illustrated in the drawings the apertures 17 being of circular configuration it is to be distinctly understood that they may be rectangular, diamond shaped, or of any other suitable configuration and still fall within the spirit and scope of this invention. The reservoir board 15 is mounted on the fireproof sheet rock sections 7, 9 and 11, and is affixed thereto by glueing or in any other suitable manner. Insulation 21 is mounted and supported on and covers the top of the reservoir board 15. The insulation 21 is preferably of a plastic air entrapment type and, as will become more evident as this description proceeds, when the insulation is subjected to heat it becomes a flowable molten mass. The insulation 21 may be affixed to the reservoir board 15 in any suitable manner. A rubber roofing membrane 23 is affixed to a lamination 25 which in turn is caused to adhere to the insulation 21.

When the elements of the roof have been assembled in roof forming position, it will be understood that the reservoir board 15 is glued or otherwise caused to adhere to the top surface of the fireproof members 5 and the apertures 17 in the reservoir board combined with the fireproof member 5 will form cups, the upper surface of the fireproof sections forming the bottoms of such cups. In the event of a fire within the building which is covered by the described roofing structure the intense heat generated will cause the insulation 21 to melt and become a flowable molten mass. Such molten mass of insulation will flow into the cup forming apertures 17 and will be held therein and prevented from flowing to the seams 13 between the fireproof member sections and then leaking down into the roof to cause intensification of the fire. In other words, this ingenious arrangement provides in effect a fire barrier for preventing intensification of a fire within the building. In order to be fully effective the apertures 17 in the reservoir board 15 must be formed therein out of alignment with the seams 13 in the sections of the fireproof member. When the roof is being installed the roofing installer lines up the visible indicia line 19 on the upper surface of the reservoir board with the seams 13 between the sections 7, 9 and 11 of the fireproof member. Since, as has been stated hereinbefore, the apertures are not formed at the indicia lines 19 and hence when the lines 19 are lined up with the seam 13, there will be no cup forming apertures over the seams 13.

Figure 3:
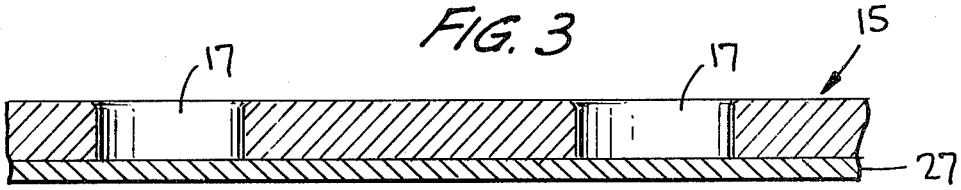
FIG. 3 is a view similar to FIG. 2 with the addition therein of a lamination to the reservoir board.

In certain installations it is found to be desirable to laminate the reservoir board 15 in order to provide sufficient stability thereto. In FIG. 3 of the drawings such lamination is illustrated at 27 and it will be evident that this provides the reservoir board 15 with substantially greater stability.

Figure 2:
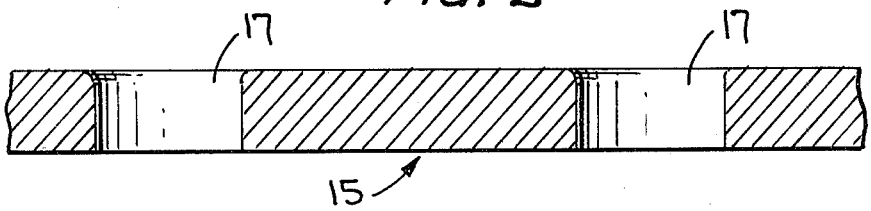
FIG. 2 is a view taken on the line 2—2 of FIG. 1.
Figure 4:
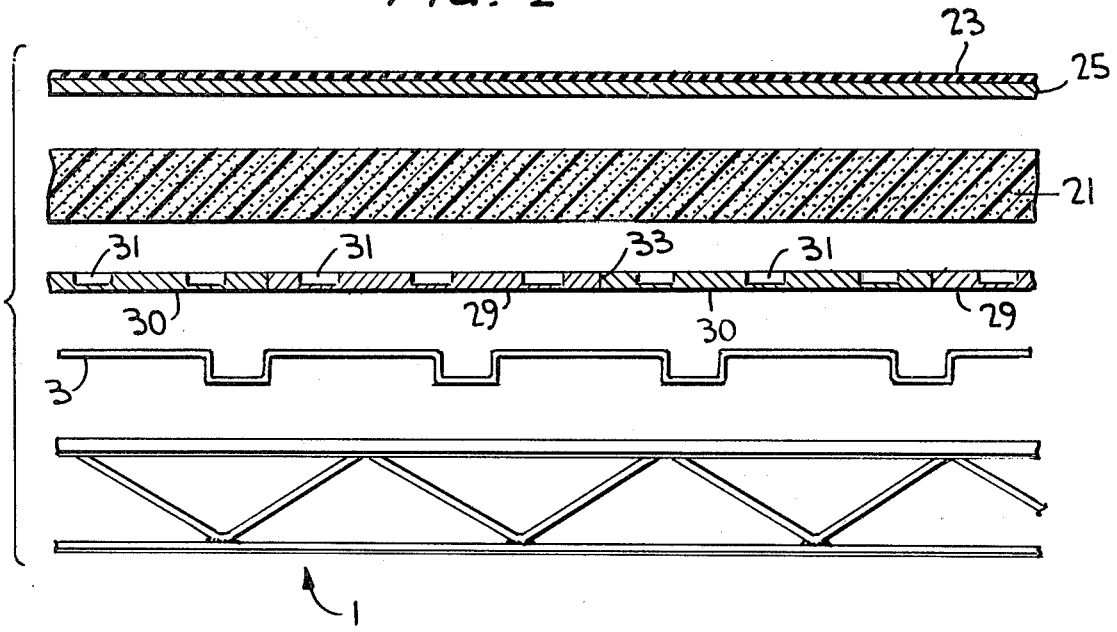
FIG. 4 is a view in section of a modified form of the invention, the elements of the roof being illustrated in exploded positions.
Figure 5:
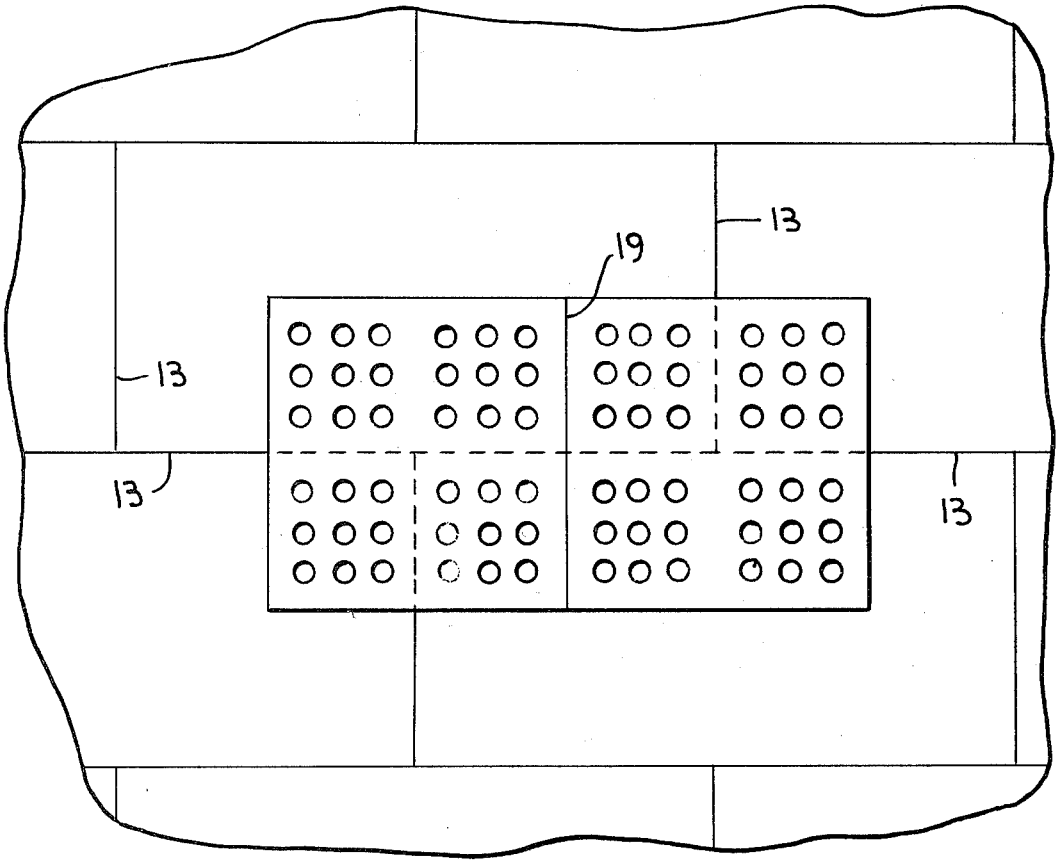
FIG. 5 is a plan view illustrating the indicia appearing on the reservoir board to properly locate said boards relative to the seams between the sections of the fireproof member.

FIG. 4 illustrates a modified form of this invention and the same reference numerals have been used to illustrate parts therein which have been used to illustrate similar parts in FIGS. 1–3. In this form of the invention the reservoir board has been eliminated and the fireproof sections designated by the numeral 29 serves in place of the hereinbefore reservoir board. The fireproof sections 29 of the fireproof member are provided with a plurality of cups 31 which, as will be apparent from consideration of FIG. 4 of the drawings, do not extend all the way through the fireproof sections 29 of the fireproof member 30. Thus, when a fire occurs in the building which is covered by this roof the insulation 21 will melt and become a molten mass and will flow into the cups 31 in the fireproof sections 29 and such molten mass will be prevented from flowing to the seams 33 with consequent leakage therethrough.

Figure 6:
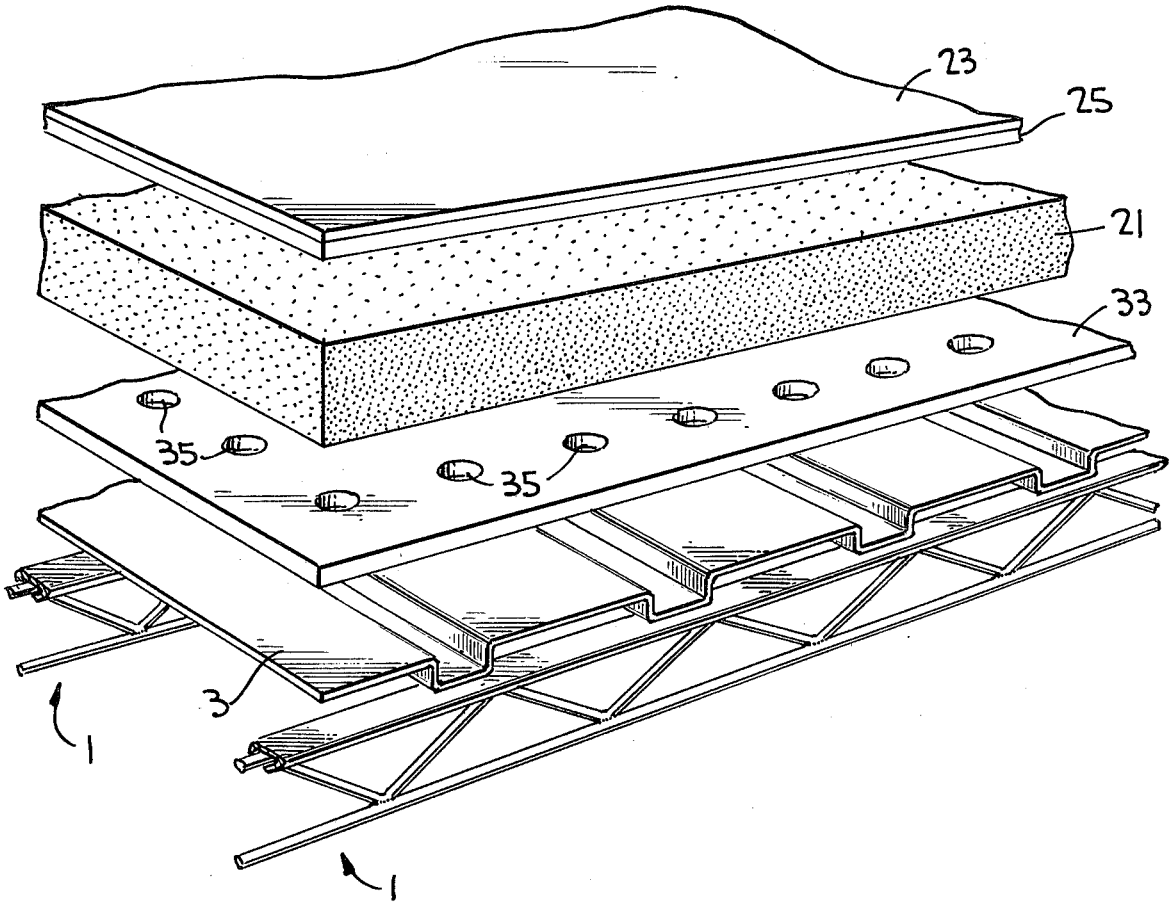
FIG. 6 is an exploded view in perspective of a roofing structure forming a modification of the invention and involves the substitution of a wood fiberboard barrier for the barriers previously illustrated.
Figure 7:
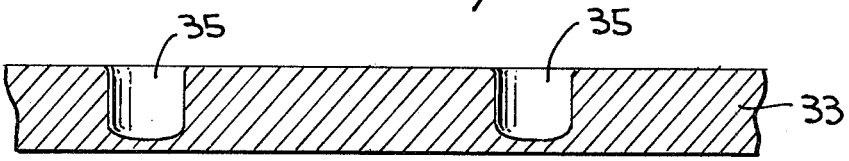
FIG. 7 is a view in section of the wood fiberboard barrier with parts thereof broken away and particularly illustrating the apertures therein which provide cups for receiving the molten insulation.

In FIGS. 6 and 7 a modified form of this invention is disclosed and in the description thereof I shall use the same reference numerals as heretofore used for similar parts. The roofing structure includes spaced apart steel joists illustrated generally by the numeral 1 and upon such roof joists a metal decking is supported and upon this metal decking a wood fiberboard fire barrier 33 is supported. This wood fiberboard member 33 is provided with a plurality of spaced apart apertures therein which extend inwardly toward the bottom of the member 33 but are spaced therefrom so that the apertures 35 form a plurality of cups within the wood fiberboard member 33. This wood fiberboard member is preferably on the order of ½" in thickness and functions in the roofing structure combination as a fire barrier to keep the molten insulation from flowing downwardly to and in contact with the metal roofing 3. The metal roofing when subjected to the heat of the molten insulation would become distorted. The wood fiberboard member 33 acts as a fireproof member and under the influence of heat from the molten insulation in the event of a fire becomes charcoal and tests have established that this wood fiberboard member 33 has a better burn rating than the steel deck 3.

Supported upon the wood fiberboard 33 is the insulation 21 and the roofing membrane 23 with its lamination 25 which are mounted on and caused to adhere to the insulation 21. It will now be recognized that in the roofing structure of FIGS. 6 and 7 the fireproof member and the separate fire reservoir board are eliminated and the wood fiberboard member 33 functions in their places as a fire barrier member.

Figure 8:
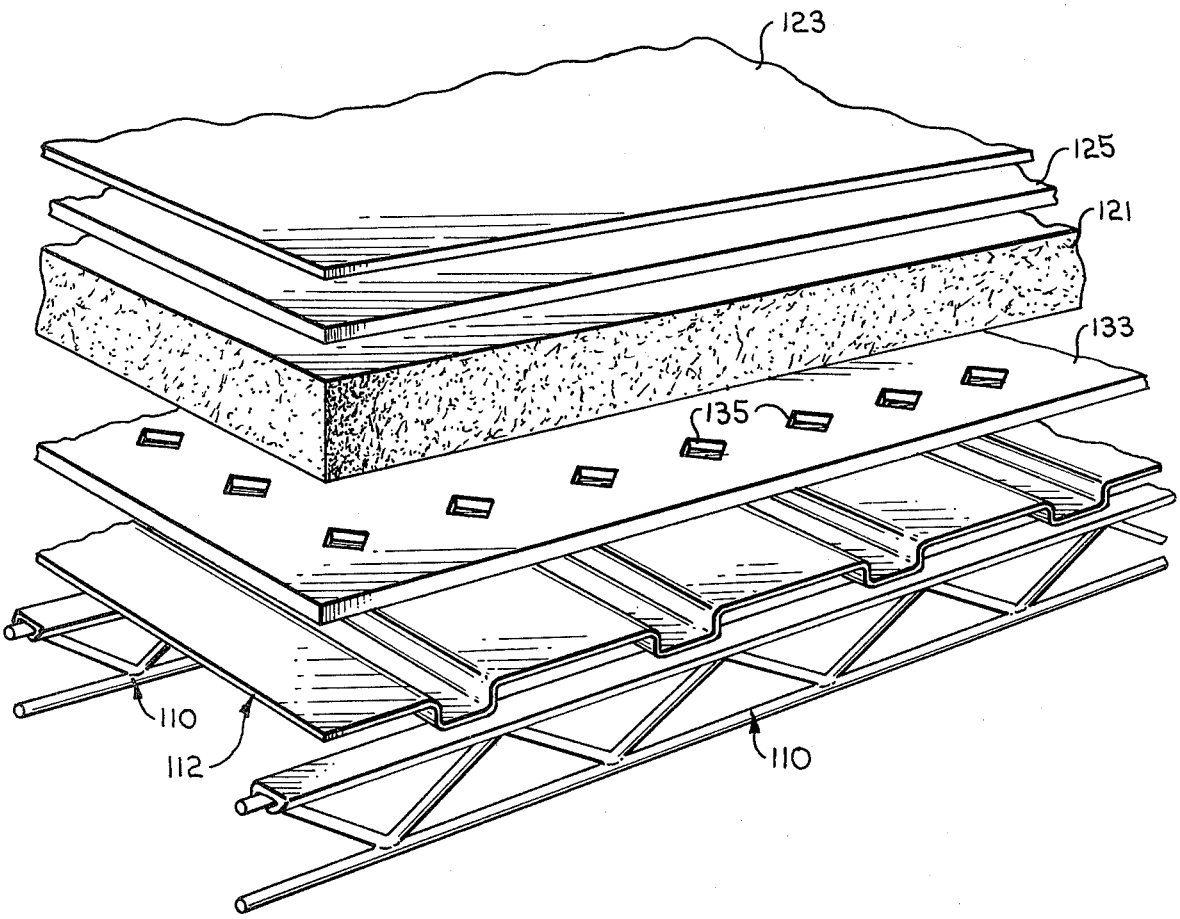
FIG. 8 is an exploded perspective view of a further modification of the invention.

In FIG. 8, a building covering structure is illustrated wherein spaced apart steel joists designated 110 support metal decking 112 on which is mounted an integral fireproof or fire resistant member designated 133, insulation 121 and an overlying lamination 125 and covering membrane 123. Fire resistant member 133 may be formed of plasterboard or the like and serves as a reservoir board with a series of suitable apertures 135 shown as being of a generally diamond-shaped configuration. Apertures 135 extend partially through board 133. In the event of a fire in a building covered by this structural assembly, insulation 121 will melt and become a molten mass and will flow into the apertures 135 of member 133 to prevent the molten mass from flowing to its seams, not shown, and possible leakage into the building interior. Intensification of the fire within the building due to leakage of the insulation 121 in a hot melt state is accordingly effectively prevented.

To further improve the disclosed structure, wherein an underlying fire resistant member, such as illustrated at 5 in FIG. 1 is divided into sections 7, 9 and 11 with abutting seams 13, a fire barrier of high integrity which is effectively impervious to the flow of molten insulation is provided by seams 13 positively secured, preferably with a tape, not shown. The tape may be formed of a suitable fire resistant material. This construction further ensures against leakage of melted insulation into the building interior in the event of fire. If desired, such taping likewise can be applied to seams 19 (FIG. 1) of adjacent sections of reservoir board 15 itself which directly underlies insulation 21.

Figure 9:
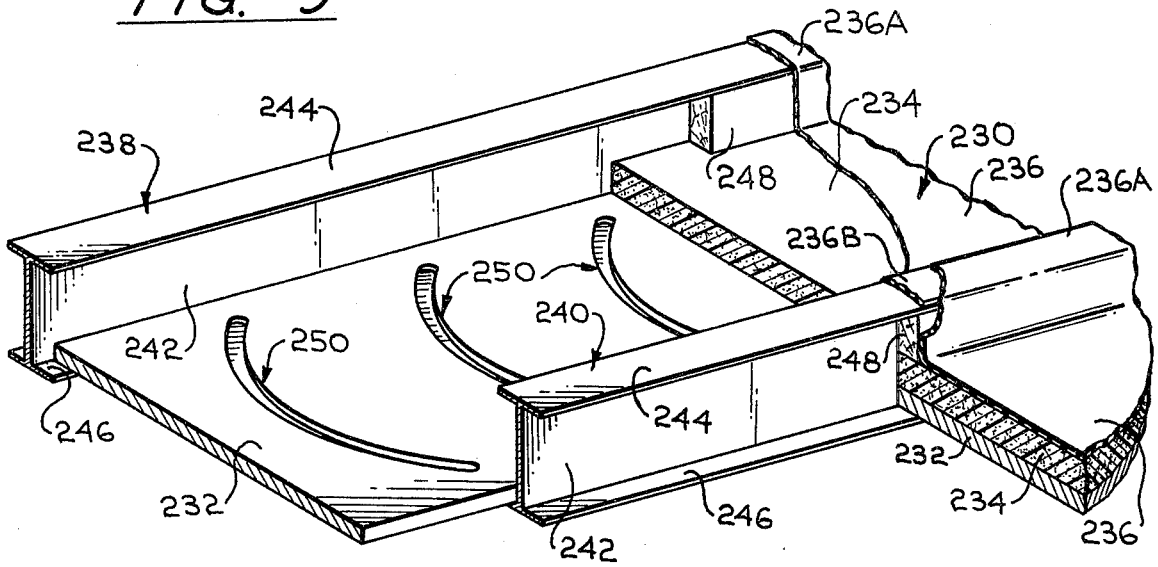
FIG. 9 is a perspective view, partly in section and partly broken away, showing another embodiment of the invention.

For quick and easy installation of a modular type building covering, FIG. 9 illustrates another embodiment of this invention wherein the basic structural components are formed in an elongated integrated panel 230 with a suitable fire resistant reservoir board 232 of unitary construction (similar to that illustrated in FIGS. 4 and 6) in underlying assembled relation to a block of insulation 234 which, as in the previously described embodiments, may be formed of plastic, preferably an air or gas entrapment type plastic which, when subjected to heat, becomes a flowable molten mass. A rubber roofing membrane 236 is provided as a cover for an exterior surface of the insulation 234. Prior to being installed, the membrane 236 has longitudinally extending free side edges 236A and 236B, it being understood that the membrane body between the free side edges 236A and 236B is fixed in any suitable fashion to the insulation 234.

Figure 11:
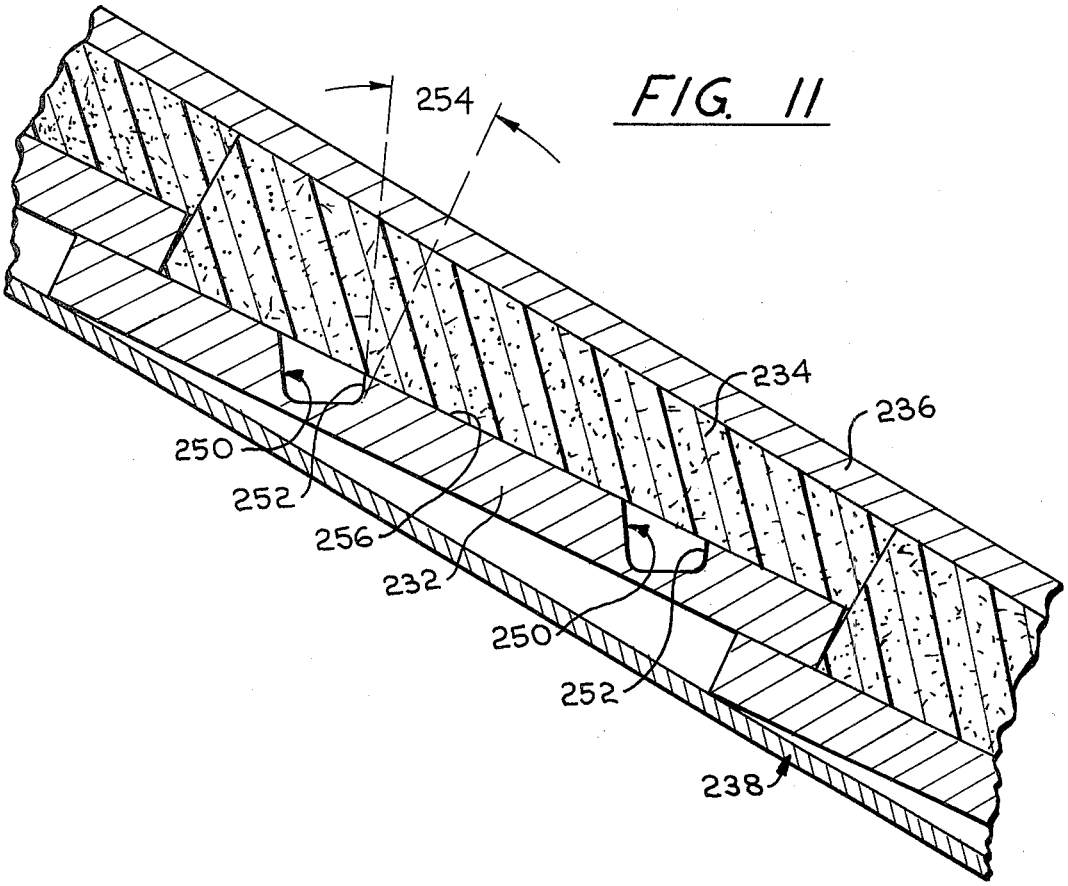
FIG. 11 is a sectional view, partly broken away, of a reservoir board showing a modification of its apertures for receiving molten insulation.

This embodiment of the invention is particularly suited to be installed as a modular panel between spaced parallel I beams 238, 240 each having a central web 242 and laterally extending upper and lower plates 244, 246. As illustrated, the insulation and reservoir board panel assembly is dimensioned and configured to be supported on confronting lower plates 246, 246 of adjacent beams 238, 240. If desired, fillers such as the illustrated longitudinally extending wooden runners 248 may be provided to secure the panel 230 in position on beams 238, 240 which serve as the supporting means for the 236A, 236B structure. The longitudinally extending free side edges of the roofing membrane 236 may then be secured in lapped relation to a membrane side edge of an adjacent panel and in overlying relation to upper plate 244 of the supporting beam with any suitable adhesive, not shown. As illustrated in FIG. 9, apertures or channels 250 are provided by arcuate depressions formed to extend partially through reservoir board 232 for receiving and retaining any molten insulation 234. If the structure of FIG. 9, for example, were provided on a sloping roof or were to serve as a sloping wall of a building, an end wall such as at 252 (FIG. 11) of each channel 250 is preferably formed so as to be generally vertically disposed in an installed position, and the end wall 252 of channel 250 forms an acute angle 254 relative to an upper surface 256 of reservoir board 232.

Figure 10:
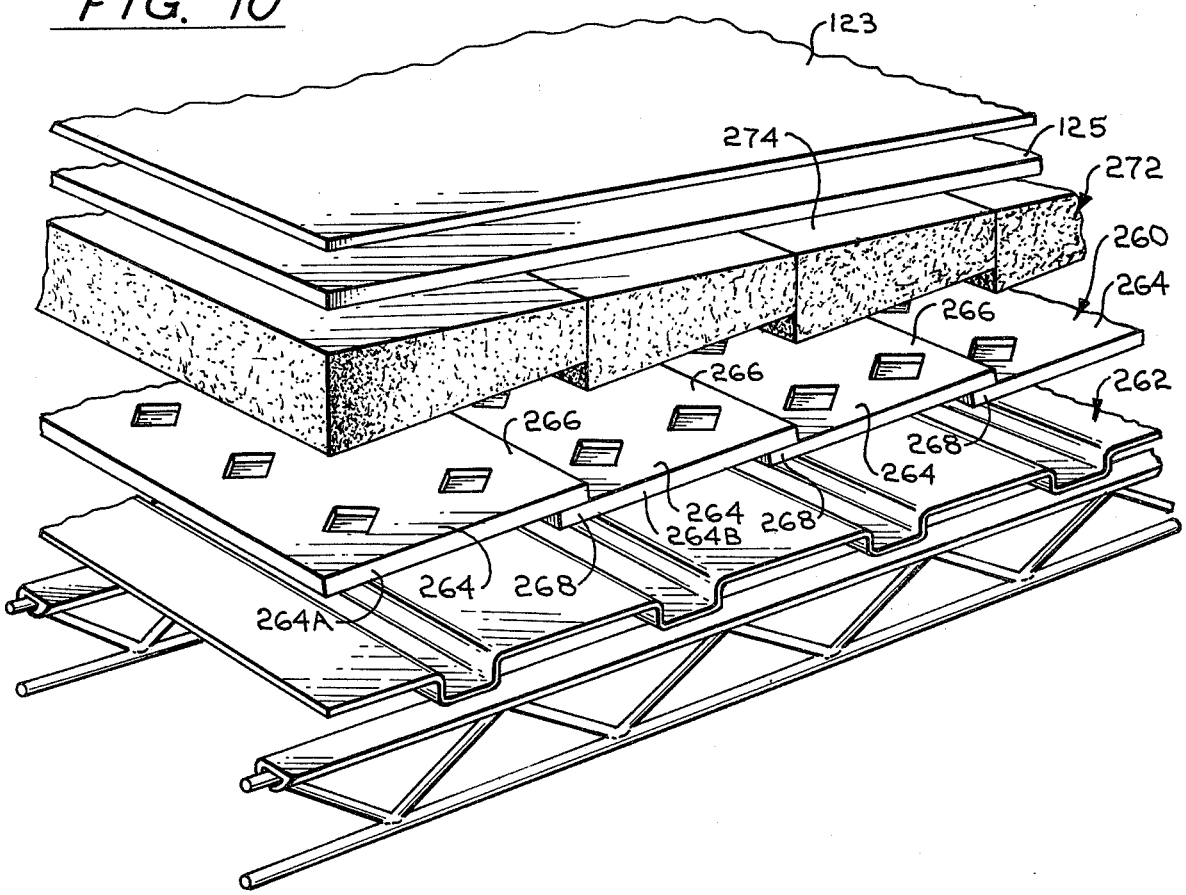
FIG. 10 is a sectional view, partly broken away, showing yet another embodiment of the invention.

Turning now to FIG. 10, another embodiment of this invention is illustrated wherein the fire barrier 260 mounted on a suitable supporting means 262 is illustrated as comprising a plurality of reservoir board sections 264 with edge portions of adjacent reservoir board sections 264 in lapping relation to one another. Such construction provides a saw tooth profile by virtue of a leading edge 266 of a trailing section such as 264A overlapping a trailing edge 268 of each leading reservoir board section such as 264B and thereby creating a containment barrier on the face of each board section 264 defined by an end wall 270 of its trailing board section for containing an excessive molten mass of insulation or overflow due to a building fire. Such construction is particularly suited to be applied on a sloping roof or sloping wall serving as a building covering structure. While the overlying insulation 272 supported on sections 264 of the reservoir board in FIG. 10 is illustrated as having a base profile corresponding to the underlying reservoir board and a generally flat planar exposed surface 274 on the insulation layer, such profiling of the insulation 272 may or may not be desired in a given installation. As in the previously described embodiments, a suitable cover such as a rubber roof membrane may be applied to the exposed surface of the insulation.

As will be apparent to persons skilled in the art, various modifications, adaptations and variations of the foregoing specific disclosure can be made without departing from the teachings of this invention.

I claim:

1. A roof structure including, in combination, a supporting means, a fireproof member mounted on said supporting means and comprising a plurality of sections with their adjacent edges in abutting relationship providing seams therebetween, a reservoir board mounted on and secured to said sections of the fireproof member, said reservoir board being provided with an aperture therein extending at least partially through the reservoir board, insulation mounted on said reservoir board, the insulation being meltable into a molten flowable mass when subjected to heat, and means covering the top surface of said insulation.

2. A roof structure in accordance with claim 1, wherein said reservoir board extends over said sections of the fireproof member and over the seams provided by the abutting edges of the sections.

3. A roof structure in accordance with claim 2, wherein the reservoir board has a plurality of apertures formed therein outside the vertical planes of said seams.

4. A roof structure in accordance with claim 1, wherein said reservoir board is provided with visible indicia lines in the vertical planes of the seams between sections of the fireproof member, in the assembled roof structure the visible indicia lines on the reservoir board being vertically aligned with the seams between sections of the fireproof member.

5. A roof structure in accordance with claim 1, wherein the reservoir board includes a plurality of cup forming apertures, and wherein when said insulation is subjected to heat and it becomes a flowable molten mass, the cup forming apertures in said reservoir board being in position to receive the molten mass and restrain such molten mass from flowing to the seams between sections of said fireproof member.

6. A roof structure in accordance with claim 1, wherein the insulation is of a plastic air entrapment type.

7. A roof structure in accordance with claim 1, wherein said reservoir board is of laminated construction.

8. A roof structure in accordance with claim 1 wherein the aperture extends completely through the fireproof member.

9. A roof structure including, in combination, a supporting means, a fireproof member mounted on said supporting means and comprising a plurality of sections with their adjacent edges in abutting relationship providing seams therein, each section of said fireproof member having an aperture therein extending at least partially through said fireproof member, insulation mounted on and covering each section of said fireproof member and the aperture formed therein, the insulation being meltable into a molten flowable mass when subjected to heat, said flowable mass being received in the open end of the aperture of each section of said fireproof member, and means covering the top surface of the said insulation.

10. A roof structure in accordance with claim 9, wherein the apertures formed in the sections of said fireproof member are respectively formed therein in positions remote from the seams therein.

11. A roof structure including, in combination, a supporting means, a wood fiber reservoir board mounted on said means, said reservoir board being provided with an aperture therein extending at least partially through said reservoir board, insulation mounted on said reservoir board, the insulation being meltable into a molten flowable mass when subjected to heat, and means covering the top surface of said insulation.

12. A building covering structure including, in combination, a supporting means, a fire resistant reservoir board mounted on said supporting means, said reservoir board being provided with an aperture therein extending at least partially through said reservoir board, and insulation mounted on said reservoir board, the insulation being meltable into a molten flowable mass when subjected to heat.

13. A structure in accordance with claim 11 or claim 12, wherein the aperture extends completely through the reservoir board, and wherein said reservoir board is mounted on an underlying fire resistant member supported on said supporting means.

14. A structure in accordance with claim 12, wherein the insulation is of a plastic gas entrapment type, and wherein means is provided covering an exterior surface of the insulation.

15. A structure in accordance with claim 13, wherein the fire resistant member underlying the reservoir board comprises a plurality of sections with their adjacent edges in abutting relationship providing seams therebetween.

16. A structure in accordance with claim 15, wherein the sections of the fire resistant member are secured at the seams to provide an underlying fire resistant member of high integrity impervious to the flow of molten insulation.

17. A structure in accordance with claim 15, wherein the sections of the fire resistant member are taped together at the seams.

18. A structure in accordance with claim 12, wherein said reservoir board comprises a plurality of sections with edge portions of adjacent reservoir board sections in lapping relation to one another.

19. A structure in accordance with claim 12, wherein the supporting means includes elongated beams in spaced parallel relation, the beams being of I shaped cross-section having a central web and laterally extending upper and lower plates, and wherein the insulation and reservoir board are assembled as an elongated panel dimensioned and configured to be supported on confronting lower plates of adjacent beams.

20. A structure in accordance with claim 19, wherein the insulation and reservoir board panel includes a rubber membrane covering the insulation with longitudinally extending side edges for lapping a membrane side edge of an adjacent panel in overlying relation to the upper plate of the supporting beam.

* * * * *